United States Patent [19]

McCorcle

[11] 4,413,591

[45] Nov. 8, 1983

[54] SUPERHEATER HANGER DESIGN

[75] Inventor: Gary E. McCorcle, Odessa, Tex.

[73] Assignee: El Paso Products Company, Odessa, Tex.

[21] Appl. No.: 352,705

[22] Filed: Feb. 26, 1982

[51] Int. Cl.[3] ..... F22B 15/00; F22B 25/00; F22B 37/10

[52] U.S. Cl. ..... 122/235 R; 122/235 A; 122/235 K; 122/493; 122/460; 165/178; 248/58

[58] Field of Search ..... 122/235 A, 235 D, 262, 122/460, 469, 473, 510, 511, 512, 6 A, 450, 478, 481, 493, 235 K; 165/178, DIG. 13; 432/233, 234; 248/58; 110/234

[56] References Cited

U.S. PATENT DOCUMENTS

| | | | |
|---|---|---|---|
| 1,791,559 | 2/1931 | Harris | 122/478 |
| 1,990,058 | 2/1935 | Attschuler | 122/478 |
| 2,032,390 | 3/1936 | Armacost | 122/481 |
| 2,515,028 | 10/1945 | Wert | 248/58 |

FOREIGN PATENT DOCUMENTS

| | | | |
|---|---|---|---|
| 533693 | 12/1929 | Fed. Rep. of Germany | 122/510 |

*Primary Examiner*—Henry C. Yuen
*Assistant Examiner*—David E. Helmbold
*Attorney, Agent, or Firm*—Depaoli & O'Brien

[57] ABSTRACT

A superheater supported in a furnace and composed of a plurality of piping lengths in which the individual pipe lengths are supported in the furnace by a pair of hanger rods pivotally mounted to the pipe lengths substantially at the ends of the pipe lengths, the rods being slidably mounted to a support surface exterior of the furnace whereby the rods are free to move in a longitudinal direction parallel to the longitudinal axis of the pipe lengths. The inlet and outlet headers to and from the superheater can comprise the support surface for the hanger rods.

4 Claims, 3 Drawing Figures

SUPERHEATER HANGER DESIGN

BACKGROUND OF THE INVENTION

1. Field of the Invention

This invention relates to a novel and improved structure for supporting tubes which are subjected to the heat of a furnace, and more particularly to a tube support structure for preventing the tubes from exceeding their bending moment and becoming distorted during superheating of a fluid passing therethrough. While the invention will be ordinarily useful as a tube support in all types of fluid superheating operations, the invention is particularly useful in superheating steam for the purpose of supplying heat required for chemical reactions such as in the formation of styrene.

2. Brief Description of the Prior Art

U.S. Pat. No. 1,896,176, Feb. 7, 1933 discloses a means for supporting tubes which are subjected to the heat of a furnace and for preventing the distortion of the tubes. In accordance with the patent, the portions of the tubes which are exposed to the radiant heat of the furnace are left free to expand inwardly as they become heated. Additionally, struts are abutted against the tubes so that outward movement of the tubes is prevented.

U.S. Pat. No. 1,941,258, Dec. 26, 1933 discloses a superheater in which substantially parallel co-planar pipe lengths include means exterior thereto for connecting an adjacent pair of pipe lengths together, the connecting means including a slidable interlocking joint so as to permit relative motion of adjacent pipe lengths in the longitudinal direction during periods of changing temperatures in the boiler.

U.S. Pat. No. 2,439,067, Apr. 6, 1948 relates to devices for supporting piping systems against vibration and shock while at the same time permitting automatic adjustment of the position of the pipe to accomodate thermal expansion or other normal and necessary relative movement between the piping and its support. An elaborate system is devised including a movably mounted truck which is adapted to roll and which supports a spring mounted hanger and lengths of piping.

U.S. Pat. No. 3,760,774, Sept. 25, 1973 and British Pat. No. 1,409,943 disclose boilers which include furnace walls which are designed to withstand the pressures and thermal changes within the furnace and which include means by which the forces exerted on the walls may be transmitted to a flexible framework.

U.S. Pat. No. 1,990,058, Feb. 5, 1935 discloses a support structure for superheaters.

While the prior art structures may have been somewhat successful in preventing the distortion of superheater tubes during the thermal expansion and contraction thereof caused by thermal changes taking place in the furnace, prior art tube support structures have been cumbersome to install and in view of the complexity of design or use of a relatively large number of connecting components difficult to maintain in the proper operating orientation. Further still, tube support structure which is mounted in the interior of the furnace is also subjected to the thermal changes taking place, and thus often becomes distorted, thereby reducing it usefulness.

Accordingly, it is a primary object of the present invention to provide a supporting arrangement for superheater units which will prevent the individual superheater tubes from exceeding their bending moment and becoming distorted in the environment of a furnace and yet shall be convenient and economical to install and maintain.

SUMMARY OF THE INVENTION

The apparatus in accordance with the present invention includes a boiler able to receive a superheater unit having a plurality of spaced inverted U-shaped piping elements, the piping elements comprised of two spaced vertical lengths and a straight horizontal cross-over piping length therebetween. The piping elements are supported for placement in the interior of the boiler in a manner which will accomodate expansion in the longitudinal direction of the cross-over length of the piping elements. Each piping element of the superheater is supported in the interior of the furnace by a securing means comprising a pair of hanger rods each of which is pivotally mounted at substantially an end of the cross-over length at each bend in the U-shaped piping element formed between the vertical lengths and cross-over length. The end of the hanger rods opposite that end which is pivotally mounted to the piping elements is slidably mounted to a support positioned exterior of the furnace whereby the hanger rod is movable relative to the exterior support in a direction parallel to the longitudinal axis of the cross-over length. Preferably, the hanger rods are mounted to the respective inlet and outlet headers which provide ingress and egress of a fluid to and from the superheater unit. The inlet and outlet headers run parallel to each other and have a longitudinal axis which is substantially perpendicular to the longitudinal axis of the cross-over length of each piping element and are spaced directly above the respective ends of the cross-over lengths. Longitudinal expansion of the cross-over lengths during periods of changing temperatures in the furnace is accomodated and limited by the hanger rods which are permitted to pivot and more relative to the exterior support in a direction parallel to the axis of the cross-over lengths of piping elements.

DETAILED DESCRIPTION OF THE INVENTION

Figure 1:
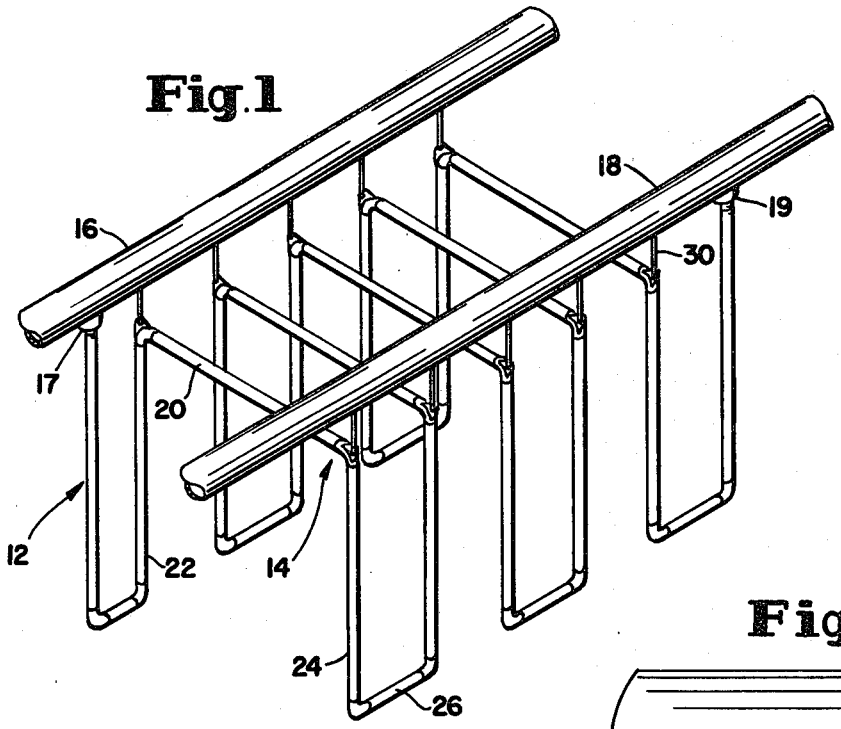
FIG. 1 is a fragmentary perspective view of the superheater unit supported by the inlet and outlet steam headers according to the teachings of the present invention.
Figure 2:
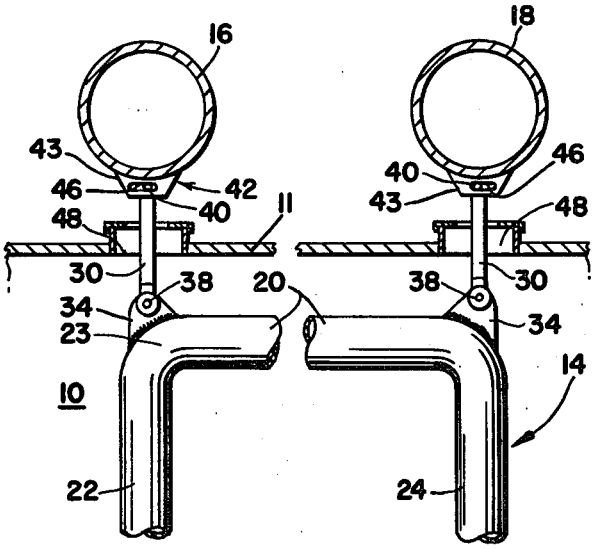
FIG. 2 is a cross-sectional view on an enlarged scale illustrating a piping element supported by the inlet and outlet headers in accordance with the invention.

The apparatus illustrated in FIGS. 1 and 2 includes a boiler 10 such as a gas or coal fired furnace having arranged therein a superheater 12. Superheater 12 comprises a plurality of piping elements 14 which are spaced along the length of furnace 10. Superheater 12 is fed by inlet steam header 16 at inlet 17 and the superheated steam produced in superheater 12 is conducted away from furnace 10 via outlet steam header 18 at outlet 19. Typically, steam entering superheater 12 via header 16 is low temperature steam at about 300° F. while the steam conducted by steam header 18 is superheated to about 1200° F. The superheater of the type illustrated is advantageously utilized to supply steam as a source of heat in a reaction vessel for the formation of styrene. This mentioned use, however, is in no way intended to limit the usefulness and scope of the invention and is only intended to illustrate one practical use which can be made of the present invention.

In the arrangement shown, piping elements 14 are of an inverted U-shape in which straight, horizontal, upper cross-over length 20 of each piping element 14 extend below the roof 11 of furnace 10. As illustrated, cross-over lengths 20 are suspended from the inlet and outlet steam headers 16 and 18, respectively. The cross-over lengths 20 of each piping element 14 are spaced from one another and form a horizontal plane within the interior of furnace 10. In the preferred form of the invention, piping elements 14 comprise cross-over length 20 extending between a pair of spaced vertical lengths 22 and 24. Each piping element 14 is spaced from an adjacent piping element 14 by means of a horizontal spacer 26 which extends between the lower ends of adjacent vertical lengths of successive piping elements 14.

Figure 3:
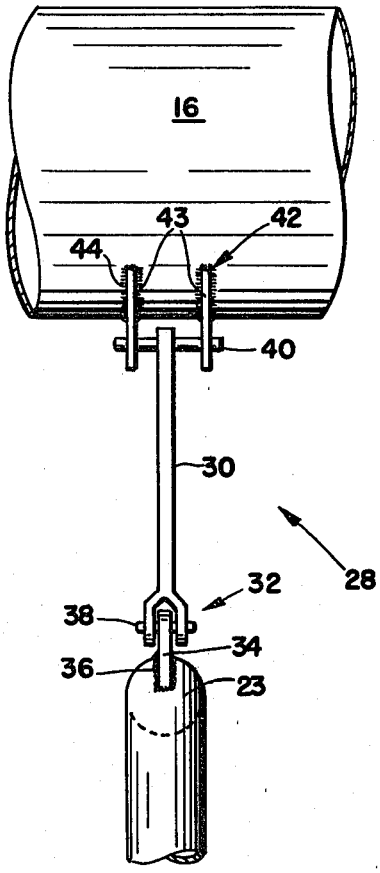
FIG. 3 is a fragmentary elevational view taken at right angles to FIG. 2.

In order that elements 14 may be adequately supported in the interior of furnace 10 to avoid the danger of the cross-over lengths 20 of elements 14 changing shape and becoming distorted due to changing temperature in furnace 10, a pair of securing means is provided between each element 14 and the inlet and outlet steam headers 16 and 18, respectively in accordance with the present invention. Each member of the pair of securing means 28, 28 is secured to the individual piping elements at substantially the ends of cross-over length 20 at the bend between the respective vertical lengths 22, 24 and the cross-over length 20. As illustrated and as best shown in FIGS. 2 and 3, each of the connecting means 28 comprises a hanger rod 30, one end of which is bifurcated to provide a clevis 32 which is pivotally secured to element 14 at the bends 23, 23 between the respective vertical lengths and the cross-over length. Clevis 32 engulfs ear 34 welded at weldments 36 to each bend 23, 23 formed in element 14. A clevis pin 38 passes through the bifurcated arms of clevis 32 and ear 34 to pivotally secure element 14 to hanger rod 30. At the upper end of hanger rod 30 and permanently secured thereto is a slide pin 40 which extends perpendicular to the longitudinal axis of hanger rod 30. Slide pin 40 is movably mounted within a slide bracket 42 comprising spaced brackets 43, 43 which are permanently secured to the underside of the respective steam headers 16 or 18 by means of weldments 44 joining the surface of brackets 43, 43 which contacts the circumferential surface of the steam header. Within each bracket 43, 43 is a slot 46 which extends horizontally in a longitudinal direction parallel to the longitudinal axis of each cross-over length 20. Slide pin 40 is mounted between brackets 43, 43 and within each slot 46 thereof and is then free to move within each slot. Accordingly, during motion of the piping elements, in particular the expansions, contraction, and distortions in the longitudinal direction of cross-over length 20 during periods of changing temperatures in furnace 10, such motion can be accomodated by the pivoting motion of hanger rods 30, 30 upon the respective clevis pins 38 and the movement of slide pin 40 within slots 46 of brackets 43, 43. Additionally, such distortions in the cross-over lengths are limited by the length of slot 46. Bending of the piping elements 14 is further limited by the contraints placed on each piping element by the spaced pair of securing means 28, 28 secured to each end of the cross-over length.

While it is shown that the individual piping elements 14 are supported from the steam headers which are placed exterior of the furnace, it is clear that securing means 28, 28 may be supported upon any exterior surface which allows the attachment of slide brackets 42, 42. Additionally, securing means 28, 28 in accordance with the present invention may be employed in an arrangement in which the superheater elements are supported from beneath. Equivalent superheater elements may be used in place of the U-shaped piping element 14 illustrated in the figures. For example, a looped superheater element that lies fully in a horizontal plane may be provided. The important feature of the present invention is the accomodation of the expansion and limitation of distortion which takes place along the longitudinal axis of each superheater element and thus the exact structure of the superheater element is not critical.

Referring again to FIG. 2, it can be seen that the individual hanger rods 30, 30 pass through apertures 48 placed in the furnace roof 11. Apertures 48 can be a single aperture to accomodate an individual hanger rod 30 or may be longitudinal slot formed in the furnace roof to accomodate the plurality of hanger rods 30 which are placed along the full superheater length within furnace 10. Some form of conventional sealing and packing means may be utilized to reduce heat loss from furnace 10.

As many possible embodiments may be made of the mechanical features of the above invention and as the art herein described might be varied in various parts, all without departing from the scope of the invention, it is to be understood that all matter hereinbefore set forth or shown in the accompanying drawings is to be interpreted as illustrative and not in a limiting sense.

What is claimed is:

1. In a boiler having disposed therewithin a superheater unit which comprises a spaced succession of upright U-shaped piping elements in the longitudinal direction and a spaced succession of inverted U-shaped piping elements in the transverse direction, each of said inverted elements comprising a straight horizontal crossover piping length between vertical portions of a pair of said upright elements and all said inverted and upright elements being connected to provide flow connection from an inlet to an outlet, an improved support means for suspending said superheater unit from support surfaces disposed outside of said boiler and for preventing said piping elements from exceeding their bending moment and becoming distorted because of thermal expansion and contraction caused by thermal changes taking place in said boiler during superheating of a fluid passing through said superheater unit from said inlet to said outlet, said support means comprising:

A. a plurality of lower pivot means, one said pivot means being attached to each end of each said crossover piping length;

B. a plurality of slide brackets, each said slide bracket being attached to said support surfaces and in approximately vertical alignment with one said lower support means; and C. a plurality of hanger rods, each being pivotally mounted on one said lower pivot means at its lower end and being pivotally and slideably attached within one said slide bracket at its upper end, whereby said hanger rods are spaced along two spaced-apart rows and said superheater unit is provided with completely balanced and independent support at a plurality of points which are in both longitudinal and transverse arrays.

2. The support means of claim 1, wherein each said lower pivot means comprises an ear in alignment with said crossover piping length and wherein each said hanger rod comprises a clevis at said lower end thereof for pivotal attachment to said ear.

3. The support means of claim 2, wherein each said hanger rod comprises a transversely disposed slide pin at said upper end for sliding within said slide bracket.

4. The support means of claim 3, wherein said support surfaces are steam headers to which said inlet and said outlet are connected.

* * * * *